United States Patent [19]

Vanderlaan

[11] Patent Number: 4,472,998

[45] Date of Patent: Sep. 25, 1984

[54] REDUNDANT CONTROL ACTUATION SYSTEM-CONCENTRIC DIRECT DRIVE VALVE

[75] Inventor: Robert D. Vanderlaan, Kalamazoo, Mich.

[73] Assignee: Pneumo Corporation, Boston, Mass.

[21] Appl. No.: 442,873

[22] Filed: Nov. 19, 1982

[51] Int. Cl.[3] ..... F15B 13/06

[52] U.S. Cl. ..... 91/510; 91/522; 137/596.15; 137/596.16

[58] Field of Search ..... 91/6, 28, 509, 510, 91/522, 453; 137/596.15, 596.16, 625.63, 625.64

[56] References Cited

U.S. PATENT DOCUMENTS

| | | | |
|---|---|---|---|
| 2,613,650 | 10/1952 | Mott | 91/6 X |
| 3,253,613 | 5/1966 | Richolt | 91/6 |
| 3,529,514 | 9/1970 | Mayo et al. | 91/509 |
| 3,683,749 | 8/1972 | Bayles | 91/509 X |
| 3,933,176 | 1/1976 | Wheeler | 137/596 |
| 4,057,004 | 11/1977 | Kamimura | 137/596 X |
| 4,090,429 | 5/1978 | Kamimura | 137/596 X |
| 4,167,135 | 9/1979 | Lindsey | 91/509 X |
| 4,212,323 | 7/1980 | Qureshi | 137/625.64 X |
| 4,333,387 | 6/1982 | Seitz | 137/596 X |
| 4,428,400 | 1/1984 | Tantardini | 137/625.64 |

FOREIGN PATENT DOCUMENTS

| | | | |
|---|---|---|---|
| 2454259 | 5/1975 | Fed. Rep. of Germany | 91/509 |
| 2461896 | 7/1976 | Fed. Rep. of Germany | 91/6 |
| 2942754 | 5/1981 | Fed. Rep. of Germany | 137/625.64 |
| 2112546 | 11/1971 | France . | |
| 860933 | 11/1958 | United Kingdom . | |

*Primary Examiner*—Robert E. Garrett
*Assistant Examiner*—Timothy E. Nauman
*Attorney, Agent, or Firm*—Maky, Renner, Otto & Boisselle

[57] ABSTRACT

A redundant control actuation system for an aircraft including an electro-mechanically controlled, hydraulically powered actuator for driving a main control valve of a servo-actuator control system. The actuator includes a tandem piston connected to the main control valve and a force motor driven tandem pilot valve axially movable in the piston for simultaneously controlling the differential application of fluid pressure from respective hydraulic systems on opposed pressure surfaces of respective piston sections to cause movement of the piston in response to relative axial movement of the pilot valve as long as at least one hydraulic system remains operative. The piston pressure surfaces are sized and arranged to minimize force unbalance on the piston due to pressure variations in the hydraulic systems. Also, a pilot valve centering spring device may be provided to minimize undesirable transient motions during system turn on and shut down. Upon failure or shut down of both hydraulic systems, a shut off valve sleeve concentric with the pilot valve moves axially in the piston to render the pilot valve inoperative and release fluid pressure from opposed, corresponding pressure surfaces of the piston sections to respective returns therefor through centering rate control orifices as the piston is moved to a neutral position by a centering spring device acting on the main control valve.

52 Claims, 6 Drawing Figures

REDUNDANT CONTROL ACTUATION SYSTEM-CONCENTRIC DIRECT DRIVE VALVE

This invention relates generally to a fluid servo system, and more particularly to an aircraft flight control servo system including a redundant control actuation system incorporating an electro-mechanically controlled, hydraulically powered actuator for use in driving a main control valve of a dual hydraulic, servo actuator control system.

BACKGROUND OF THE INVENTION

Fluid servo systems are used for many purposes, one being to position the flight control surfaces of an aircraft. In such an application, system redundancy is desired to achieve increased reliability in various modes of operation, such as in a control augmentation or electrical mode.

In conventional electro-hydraulic systems, plural redundant electro-hydraulic valves have been used in conjunction with plural redundant servo valve actuators to assure proper position control of the system's main control servo valve in the event of failure of one of the valves and/or servo actuators, or one of the corresponding hydraulic systems. Typically, the servo actuators operate on opposite ends of a linearly movable valve element of the main control valve and are controlled by the electrohydraulic valves located elsewhere in the system housing. Although the servo valve actuators, alone or together, advantageously are capable of driving the linearly movable valve element against high reaction forces, such added redundancy results in a complex system with many additional electrical and hydraulic elements necessary to perform the various sensing, equalization, failure monitoring, timing and other control functions. This gives rise to reduced overall reliability, increased package size and cost, and imposes added requirements on the associated electronics.

An alternative approach to the electro-hydraulic control system is an electro-mechanical control system wherein a force motor is coupled directly and mechanically to the main control servo valve. In this system, redundancy has been accomplished by mechanical summation of forces directly within the multiple coil force motor as opposed to the conventional electro-hydraulic system where redundancy is achieved by hydraulic force summing using multiple electro-hydraulic valves, actuators and other associated hydro-mechanical failure monitoring elements. If one coil or its associated electronics should fail, its counterpart channels will maintain control while the failed channel is uncoupled and made passive. Such alternative approach, however, has a practical limitation in that direct drive force motors utilizing state of the art rare earth magnet materials are not capable of producing desired high output forces at the main control servo valve within acceptable size, weight, and power limitations.

In aircraft flight control systems it also is advantageous and desirable to provide for controlled recentering of the main control servo valve in the event of a total failure or shut-down of the electrical operational mode. This is particularly desirable in those control systems wherein a manual input to the main servo valve is provided in the event that a mechanical reversion is necessary after multiple failures have rendered the electrical mode inoperative. In known servo systems of this type, the manual input may operate upon the spool of the main servo valve whereas the electrical input operates upon the movable sleeve of the main servo valve.

Upon rendering the electrical mode inactive, it is necessary to move the valve sleeve to a neutral or centered position and lock it against movement relative to the valve spool controlled by the manual input. Heretofore, this has been done by using a centering spring device which moves the valve sleeve to its centered or neutral position and a spring biased plunger that engages a slot in the valve sleeve to lock the latter against movement. The plunger normally is maintained out of engagement with the slot during operation in the electrical mode by hydraulic system pressure, and may have a tapered nose that engages a similarly tapered slot in the valve sleeve to assist in centering the valve sleeve.

Such centering and locking arrangement, however, is subject to several drawbacks. For instance, in the event a chip or some other obstruction becomes lodged between the valve spool and sleeve or otherwise a high friction condition should occur therebetween, substantial reactive forces may be applied through the manual input path to the sleeve which may result in unseating of the plunger which in turn would render the manual mode and thus the entire control system inoperable.

OBJECTS OF THE INVENTION

With the foregoing in mind, it is a principal object of this invention to provide a redundant control actuation system for driving the main control valve of a servo actuator control system which obtains the advantages of both electro-hydraulic and electro-mechanical control systems while eliminating drawbacks associated therewith.

Another principal object of the invention is to provide such a control actuation system that has high reliability, reduced complexity, and reduced package size and cost in relation to known comparable systems.

Still another object of the invention is to provide such a control actuation system that is capable of driving the main control valve against relatively high reaction forces.

Yet another object of the invention is to provide such a control actuation system which is capable of being electro-mechanically controlled by a linear or rotary force motor drive within acceptable size, weight, and power limitations.

A further object of this invention is to provide such a control actuation system which effects re-centering of the main control servo valve at a controlled rate under system shut-down or failure conditions.

A still further object of the invention is to provide such a control actuation system which is relatively insensitive to hydraulic system pressure variations and which reduces the potential for undesirable transient motions during system turn-on or shut-down.

Another object of the invention is to provide such a control actuation system which has high stiffness and is capable of supporting high loads.

SUMMARY OF THE INVENTION

To the achievement of these and other objects, the present invention provides a redundant control actuation system which finds particular utility in an aircraft servo actuator control system, the actuation system including an electro-mechanically controlled, hydraulically powered actuator for driving a main control servo valve element of the control system. Briefly, the actuator includes a tandem piston connected to the main control valve element and a force motor driven tandem pilot valve axially movable in the piston for simultaneously controlling the differential application of fluid pressure from respective hydraulic systems on opposed pressure surfaces of respective piston sections to cause movement of the piston in response to relative axial movement of the pilot valve as long as at least one hydraulic system remains operative. The piston is movable to a null positional relationship with the pilot valve providing balanced application of pressure forces on the opposed pressure surfaces of the piston sections whereby unitary positional feedback is effected between the piston and pilot valve.

The pilot valve may be directly driven by a linear or rotary force motor drive which may be of relatively small size and power requirements and yet the system is capable of driving the main control valve element against high reaction forces as the valve element is hydraulically powered by one or both of the hydraulic systems. In addition, the piston pressure surfaces are sized and compactly arranged to minimize force unbalance on the piston due to pressure variations in the hydraulic systems. Also, a pilot valve centering spring device may be provided to minimize undesirable transient motions during system turn-on and shut-down.

According to another aspect of the invention, a shut-off valve sleeve concentric with the pilot valve renders the pilot valve inoperative upon failure or shut-down of both hydraulic systems and releases fluid pressure from opposed, corresponding pressure surfaces of the piston sections to respective returns therefor through respective centering rate control orifices as the piston is moved to a neutral position by a centering spring device acting on the main control valve. For normal operation, the shut-off valve sleeve is movable by fluid pressure from either hydraulic system to a position permitting controlled differential application of fluid pressure to the piston sections by the pilot valve. In addition, system pressure is applied to the actuator mechanism through shut-down valves which, upon shut-down of the system, disconnect the actuator from system pressure sources and release fluid pressure from other opposed, corresponding pressure surfaces of the piston sections to return through flow restricting orifices, whereby the piston is hydraulically locked against high loads of short duration.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 6 is a fragmentary perspective view showing a portion of the rotary force motor drive of FIG. 5.

DETAILED DESCRIPTION

Figure 1:
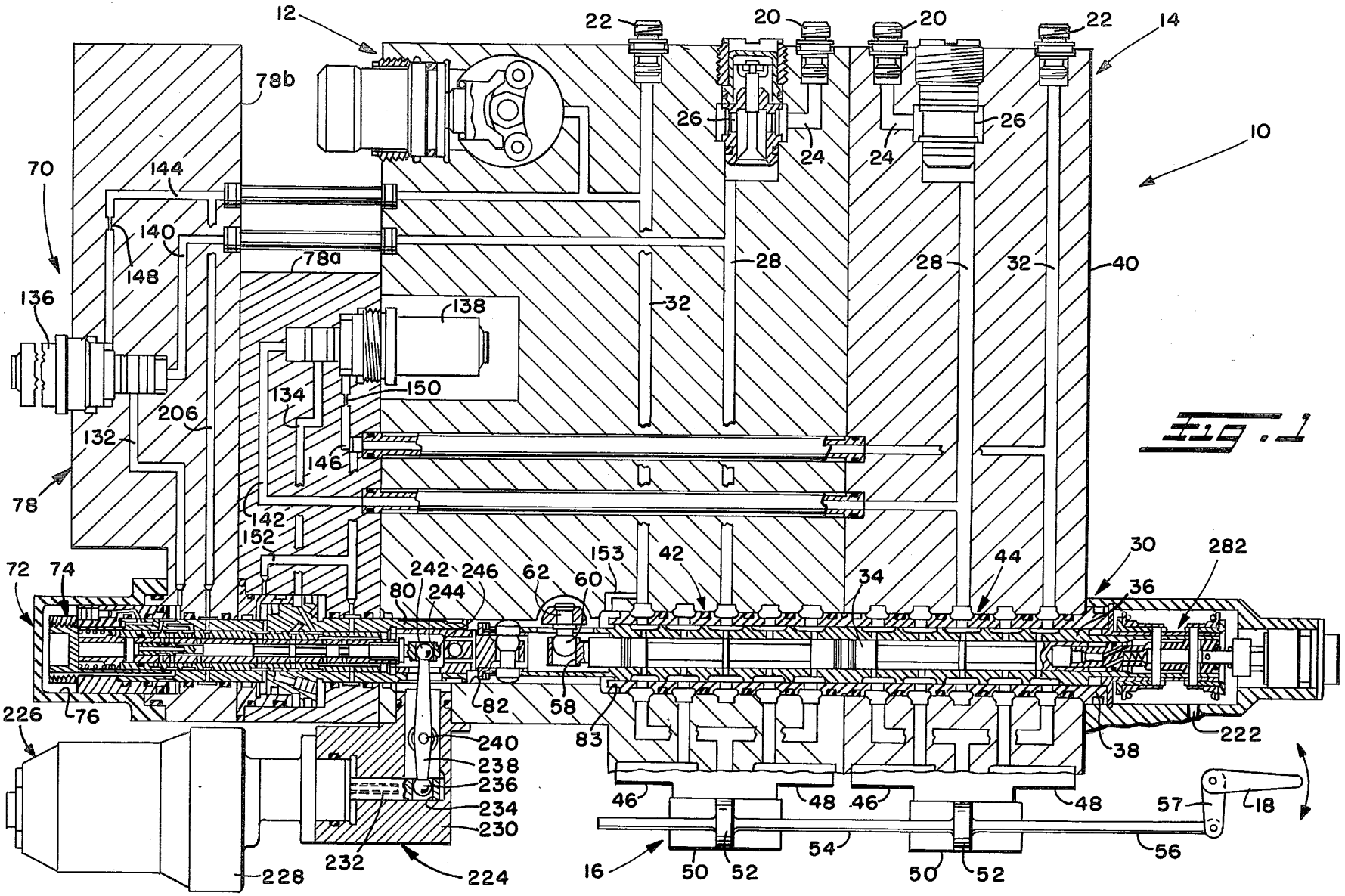
FIG. 1 is a schematic illustration of a redundant servo system embodying a preferred form of control actuation system according to the invention.

Referring now in detail to the drawings and initially to FIG. 1, a redundant servo system in designated generally by reference numeral 10 and includes two similar hydraulic servo actuators 12 and 14 which are connected to a common output device such as a dual tandem cylinder actuator 16. The actuator 16 in turn is connected to a control member such as a flight control element 18 of an aircraft. It will be seen below that the two servo actuators normally are operated simultaneously to effect position control of the actuator 16 and hence the flight control element 18. However, each servo actuator preferably is capable of properly effecting such position control independently of the other so that control is maintained even when one of the servo actuators fails or is shut down. Accordingly, the two servo actuators in the overall system provide a redundancy feature that increases safe operation of the aircraft. The servo actuators seen in FIG. 1 are similar and for ease in description, like reference numerals will be used to identify corresponding like elements of the two servo actuators.

The Servo Actuators

The servo actuators 12 and 14 each have an inlet port 20 for connection with a source of high pressure hydraulic fluid and a return port 22 for connection with a hydraulic reservoir. Preferably, the respective inlet and return ports of the servo actuators are connected to separate and independent hydraulic systems in the aircraft, so that in the event one of the hydraulic systems fails or is shut down, the servo actuator coupled to the other still functioning hydraulic system may be operated to effect the position control function. Hereinafter, the hydraulic systems associated with the servo actuators 12 and 14 will respectively be referred to as the aft and forward hydraulic systems.

In each of the servo actuators 12 and 14, a passage 24 connects the inlet port 20 to a check valve 26 which in turn is connected by passage 28 to a servo valve 30. Another passage 32 connects the return port 22 to the same servo valve 30.

The main control servo valve 30 includes a spool 34 which is longitudinally shiftable in a sleeve 36. The sleeve 36 in turn is longitudinally shiftable in a tubular insert 38 in the system housing 40. The spool and sleeve are divided into two fluidically isolated valving sections indicated generally at 42 and 44 in FIG. 1, which valving sections are associated respectively with the actuators 12 and 14 and the passages 28 and 32 thereof. Each valving section of the spool and sleeve is provided with suitable lands, grooves and passages such that either one of the spool or sleeve may be maintained at a neutral or centered position, and the other selectively shifted for selectively connecting the passages 28 and 32 of each servo actuator to passages 46 and 48 in the same servo actuator.

The passages 46 and 48 of both servo actuators 12 and 14 are connected to the dual cylinder tandem actuator 16 which includes a pair of cylinders 50. The passages 46 and 48 of each servo actuator are connected to a corresponding one of the cylinders at opposite sides of the piston 52 therein. If desired, anti-cavitation valves may be provided in the passages 46 and 48. The pistons 52 or the cylinders 50 are interconnected by connecting rod 54 and further are connected by output rod 56 to the control element 18 through linkage 57.

From the foregoing, it will be apparent that selective relative movement of the spool 34 and sleeve 36 simultaneously controls both valving sections 42 and 44 which selectively connect one side of each cylinder 50 to a high pressure hydraulic fluid source and the other side to fluid return for effecting controlled movement of the output rod 56 either to the right or left as seen in FIG. 1. In the event one of the servo actuators fails or is shut down, the other servo actuator will maintain control responsive to selective relative movement of the spool and sleeve.

The relatively shiftable spool 34 and sleeve 36 provide for two separate operational modes for effecting the position control function. The spool, for example, may be operatively associated with a manual operational mode while the sleeve is operatively associated with a control augmented or electrical operational mode. In the manual operational mode, spool positioning may be effected through direct mechanical linkage to a control element in the aircraft cockpit. As seen in FIG. 1, the spool may have a cylindrical socket 58 which receives a ball 60 at the end of a crank 62. The crank 62 may be connected by a suitable mechanical linkage system to the aircraft cockpit control element. For a more detailed description of such a mechanical linkage system, reference may be had to U.S. Pat. No. 3,956,971 entitled "Stabilized Hydromechanical Servo System", issued May 18, 1976.

Normally, the manual control mode will remain passive unless a failure renders the electrical mode inoperable. During operation in the electrical mode, the spool 34 is held in a neutral or centered position while the sleeve 36 is controllably shifted to effect the position control function by the hereinafter described control actuation system designated generally by reference numeral 70.

The Control Actuation System

The control actuation system 70 of the invention includes an electro-mechanically controlled, hydraulically powered actuator 72 which is shown positioned generally in axial alignment with the main control servo valve 30 as seen at the left in FIG. 1. The actuator mechanism 72 includes a tandem piston 74 which is positioned for axial movement in a stepped cylinder bore 76 in the actuation system housing 78 as described hereafter. At its end nearest the servo valve 30, the piston 74 has a stepped cylindrical sleeve extension 80 which extends axially in a cylindrical chamber 82 of the housing 40, which chamber may be an axial continuation of the cylindrical housing bore 83 accommodating the tubular insert 38.

Figures 2, 3, 4, 5:
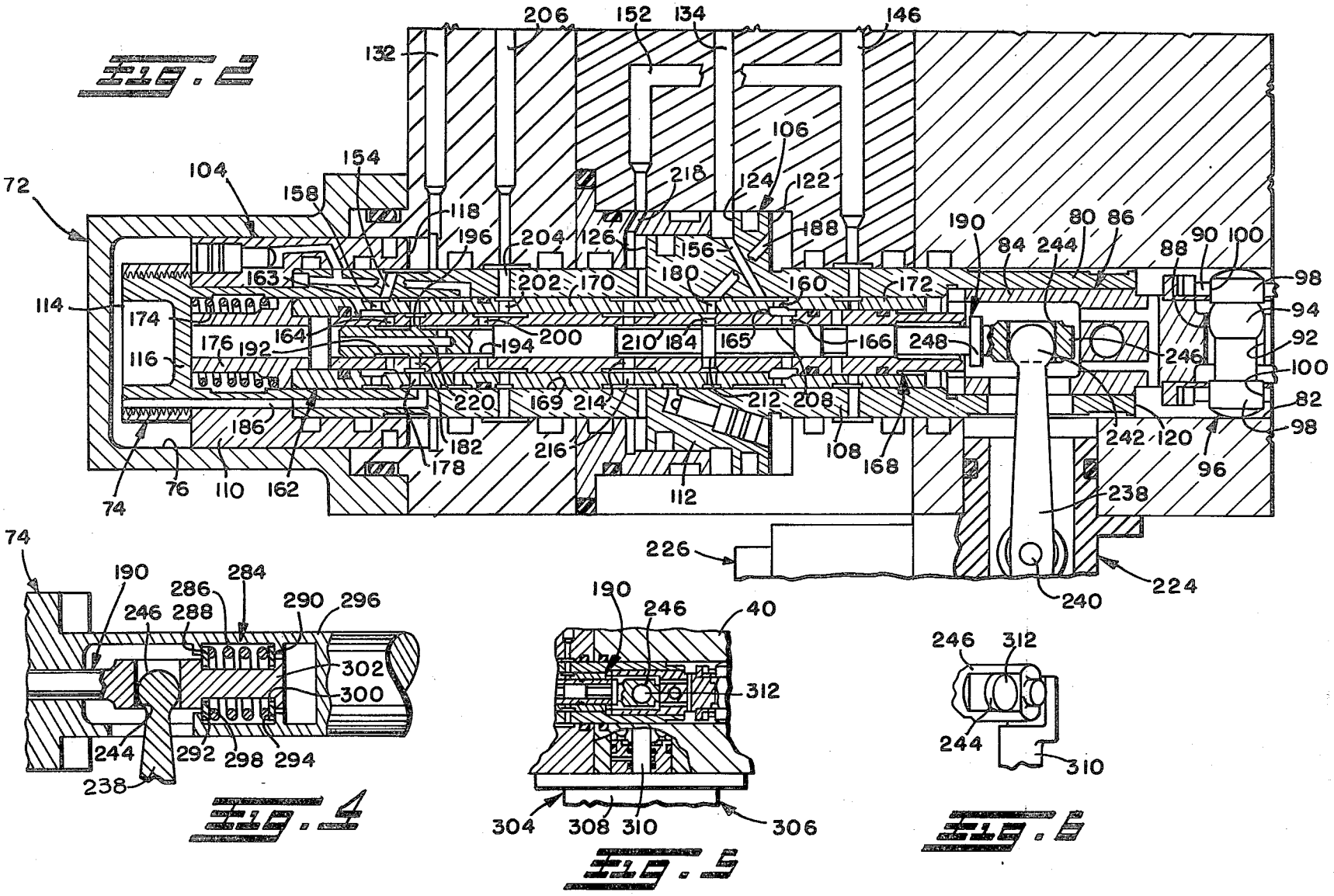
FIG. 2 is an enlarged section of the electro-mechanically controlled, hydraulically powered actuator of the control actuation system of FIG. 1 shown in its operational condition.
FIG. 3 is an enlarged section similar to FIG. 2 but showing the shut-down condition of the actuator.
FIG. 4 is a fragmentary sectional view principally showing a pilot valve centering device.
FIG. 5 is a fragmentary section showing principally a rotary force motor drive.
Figure 3:
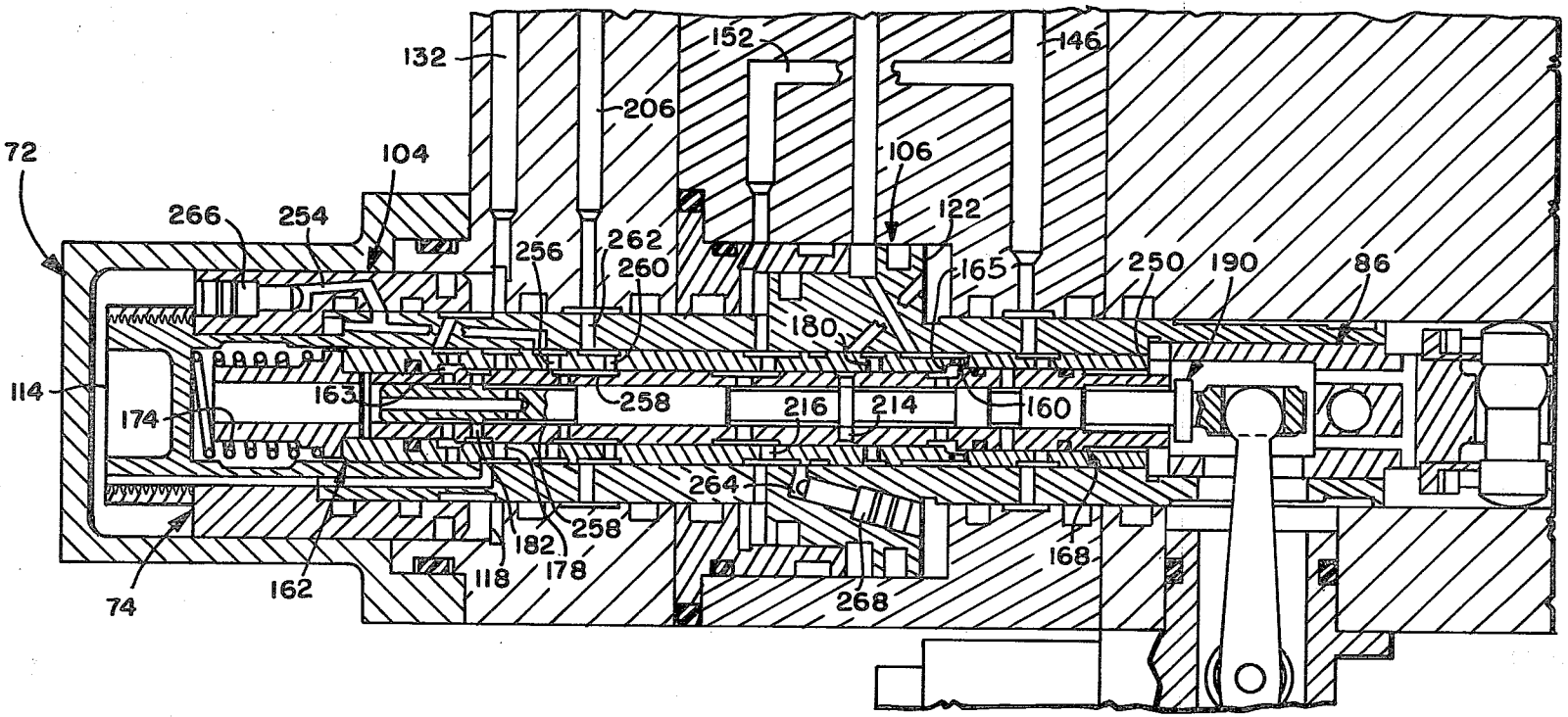

With particular reference to FIG. 2, the cylindrical sleeve extension 80 has fitted and secured therein the cylindrical skirt 84 of a piston end member 86 which further has a tongue 88 extending axially into an axial cylindrical extension 90 of the main control servo valve sleeve 36. The tongue 88 has a diametrically extending, cylindrical socket bore 92 in which is closely fitted the central ball portion 94 of a connecting pin 96. The connecting pin 96 extends diametrically beyond the tongue 88 and has cylindrical end portions 98 which are closely fitted in diametrically aligned bores 100 in the cylindrical extension 90 thereby to effect interconnection of the piston 74 and the valve sleeve 36 for common axial (linear) movement. Preferably, the tongue 88 is of a lesser dimension than the inner diameter of the cylindrical extension 90 whereby slight pivotal movement of the piston end member 86 about the ball portion 94 of the connecting pin is permitted for the purpose of avoiding piston and valve side loads in the event the piston and valve sleeve are slightly out of alignment. In addition, the ends of the connecting pin bearing against the cylindrical surface of the housing bore 82 may be rounded as shown to facilitate such common axial movement of the piston 74 and valve sleeve 36.

Referring now in particular to the tandem piston 74, such can be seen to include two serially connected or arranged piston sections designated generally by reference numerals 104 and 106. The piston section 104 is formed by a cylindrical piston sleeve 108 and a larger diameter piston head 110 fitted on and secured to the piston sleeve at its end furthest from the main control servo valve 30. The other piston section 106 is formed by a centrally located, stepped diameter piston head 112 which, as shown, may be integrally formed with the piston sleeve 108.

The piston section 104 has a cylinder pressure surface 114 which is formed by the exposed outer end face of the piston head 110 and the closed outer end wall 116 of the piston sleeve 108. In opposition to the cylinder pressure surface 114, the piston section 104 further has a source pressure surface 118 and a return pressure surface 120. As shown, the source pressure surface 118 is formed by the exposed inner end face of the piston head 104 whereas the return pressure surface 120 is formed by the exposed inner end face of the piston sleeve 108.

Similarly, the piston section 106 has a cylinder pressure surface 122 and opposed source and return pressure surfaces 124 and 126. The cylinder pressure surface 122 is formed by the exposed inner end face of the piston head 112 whereas the source and return pressure surfaces 124 and 126 respectively are formed by the radially outer and inner annular faces of the stepped diameter piston head 112.

For reasons that will become more apparent below, the effective pressure area of each cylinder pressure surface 114, 122 is twice that of the respective opposed source pressure surface 118, 124. In addition, the effective pressure area of each source pressure surface 118, 124 is equal that of the respective return pressure surface 120, 126. Accordingly, the effective pressure areas of the source and return pressure surfaces of each piston section together equal that of the respective opposed cylinder pressure area. It also should be noted that the corresponding cylinder, source and return pressure surfaces of the piston sections are opposed and have equal effective pressure areas. This results in balanced forces acting on the piston sections which have matched characteristics and the advantages thereof will become more apparent below.

The source pressure surfaces 118 and 124 of the piston sections 104 and 106 respectively are in fluid communication with passages 132 and 134 which, as seen in FIG. 1, lead to shut-down valves 136 and 138, respectively. The shut-down valves 136 and 138 may be conventional three-way, solenoid-operated valves which when energized respectively establish communication between the passages 132 and 134 and supply passages 140 and 142 that connect the shut-down valves to the passages 28 of the servo actuators 12 and 14, respectively. When de-energized, the shut-down valves 136 and 138 respectively connect the passages 132 and 134 to return passages 144 and 146 which are connected to the return passages 32 of the servo actuators 12 and 14, respectively. For a purpose that will become more apparent below, the passages 144 and 146 have therein centering rate control of metering orifices 148 and 150, respectively.

Independently of the shut-down valves 136 and 138, the return pressure surfaces 120 and 126 are in fluid communication with the return passages 32 of the servo actuators 12 and 14, respectively. Such communication between the return pressure surface 126 and the return passage 32 of the servo actuator 14 may be effected by a passage 152 which is connected to the return passage 146, whereas fluid communication between the return pressure surface 120 and the return passage 32 of the servo actuator 12 may be effected by a passage 153 interconnecting the chamber 82 to such return passage as shown in FIG. 1.

Referring again in particular to FIG. 2, the source pressure surfaces 118 and 124 also respectively are in fluid communication with ports 154 and 156 which extend generally radially through the piston 74. The ports 154 and 156 in turn respectively are connected to ports 158 and 160 in a shutoff valve sleeve 162, and the ports 158 and 160 in turn respectively are connected to ports 164 and 166 in a tubular porting sleeve 168. The shut-off valve sleeve 162 and tubular porting sleeve 168 are concentrically arranged in a concentric axial bore 169 of the piston 74 with the shut-off valve sleeve being radially constrained between and axially shiftable relative to the piston and porting sleeve, and the porting sleeve being fixed to the piston for axial movement therewith. The porting sleeve may for instance be integrally formed with the piston end member 86.

As shown, the shut-off valve sleeve 162 has a cylindrical outer surface of constant diameter, whereas the radially inner surface thereof, and thus the opposed radially outer surface of the porting sleeve 168, is radially stepped along its axial length to provide different thickness valve sleeve portions. As a result, the shut-off valve sleeve has a slightly reduced thickness central portion 170 extending between the ports 158 and 160 and a still further reduced thickness portion 172 extending to the right of the port 160 thus providing two differential pressure surfaces 163, 165 on the inner surface of the shut-off valve sleeve adjacent the left side of each of the ports 158 and 160 as viewed in FIG. 2 and exposed to the fluid pressure supplied thereto. Thus, connection of either or both ports 156, 158 to respective sources of high pressure fluid will shift the shut-off valve to the left relative to the piston and porting sleeve and to its open position seen in FIG. 2.

Such shifting of the shut-off valve sleeve 162 is opposed by the force exerted by a shut-off valve spring 174 which is positioned at the closed end of the piston bore 169 and bears in opposition against the piston end wall 116 and a flange on a shut-off valve sleeve extension piece 176. The extension piece 176 extends axially and interiorly of the spring 174 coiled thereabout and serves to axially align the spring and act as a stop to define the open position of the shut-off valve sleeve when butted against the end wall 116 as seen in FIG. 2.

When the shut-off valve sleeve 162 is in its open position, ports 178 and 180 in the shut-off valve sleeve respectively effect communication between ports 182 and 184 in the porting sleeve 168 and the ports 186 and 188 in the piston 74 which in turn communicate with the cylinder pressure surfaces 114 and 122, respectively. In addition, the ports 182 and 184 are associated with respective axially arranged valving sections of a tandem pilot valve plunger 190.

The tandem pilot valve plunger 190 is concentric with and constrained for axial movement relative to the piston 74 by the porting sleeve 168. The valving section of the valve plunger associated with the port 182 consists of annular grooves 192 and 194 which are axially separated by a metering land 196. The metering land 196 is operative to block communication between the associated port 182 and the grooves 192 and 194 when the piston 74 is at a null positional relationship with the pilot valve plunger 190. However, upon axial movement of the pilot valve plunger relative to the piston and out of such null positional relationship, the metering land is operative to effect communication between the port 182 and one or the other of the grooves 192 and 194 depending on the direction of movement.

The groove 192 is in fluid communication with the port 164 in the porting sleeve 168 which in turn communicates with the port 158. Accordingly, fluid pressure will be supplied to the groove 192 upon application of fluid pressure from the aft hydraulic system on the source pressure surface 118 of the piston section 104. The other groove 194 is in communication with a port 200 in the porting sleeve which in turn communicates via a port 202 in the shut-off valve sleeve 162 and a port 204 in the piston 74 with a passage 206 connected to the return passage 144. Accordingly, the groove 194 is connected to the return of the respective or aft hydraulic system.

Similarly, the valving section of the pilot valve plunger 190 associated with the port 184 has a pair of annular grooves 208 and 210 which are axially separated by a metering land 212 which is operative in the same manner as the metering land 196 but in association with the port 184. The groove 208 is in fluid communication with the source pressure surface 124 of the piston section 106 via ports 160 and 166 in the shut-off valve sleeve and porting sleeve, respectively. The other groove 210 is in fluid communication with return passage 152 of the respective or forward hydraulic system via a port 214 in the porting sleeve, port 216 in the shut-off valve sleeve and port 218 in the piston.

The pilot valve plunger 190 also has a port 220 which connects the groove 194 to the left or outer end of the piston bore 169. Accordingly, the left or outer end face of the pilot valve plunger 190 is exposed to return pressure of the aft hydraulic system associated with the piston section 104 of actuator 12. Likewise, the right or inner end of the plunger is exposed to return pressure of the aft hydraulic system, it being appreciated that the chamber 82 is at such aft return pressure as above indicated. Similarly, both exposed ends of the main control valve sleeve 36 of the main control servo valve 30 are exposed to the same aft return pressure, the left end thereof being exposed to such return pressure in the chamber 82 and the other or right end to such return pressure via passage 222 seen at the right in FIG. 1. This ensures that return pressure variations will not apply unbalanced forces and consequent inputs to the plunger and main control valve sleeve.

It should now be apparent that selective axial movement of the tandem pilot valve plunger 190 relative to the piston 74 simultaneously controls both valving sections thereof which in turn control the differential application of fluid pressure from respective independent hydraulic systems on the opposed pressure surfaces of the piston sections 104 and 106. If the plunger is moved to the right from its null positional relationship with the piston, fluid pressure is applied to the cylinder pressure surface 114 of piston section 104 from the aft hydraulic system source associated therewith while fluid pressure is released from cylinder pressure surface 122 of piston section 106 to the forward hydraulic system return associated therewith. The resultant pressure imbalance will hydraulically power the piston, and thus the main control servo valve sleeve 36, to the right until the ports 182 and 184 are closed by the metering lands 196 and 212, respectively, upon the piston assuming the null positional relationship with the plunger. Conversely, if the plunger is moved to the left from its null positional relationship with the piston, fluid pressure is applied to the cylinder pressure surface 122 of piston section 106 from the forward hydraulic system source associated therewith while fluid pressure is released from cylinder pressure surface 114 of piston section 104 to the aft hydraulic system return associated therewith. Under these conditions, the resultant pressure imbalance will hydraulically power the piston and valve sleeve 36 to the left until the ports 182 and 184 are closed upon the piston assuming the null positional relationship with the plunger.

Accordingly, the tandem piston 74 will track the tandem pilot valve plunger 190 whereby unitary positional feedback is effected between the plunger and piston. That is, movement of the plunger in either direction dictates like movement of the piston. In addition, either piston section and associated valving section of the plunger will maintain control of the piston in the event that the hydraulic system associated with the other is shut down or otherwise lost.

With reference to FIGS. 1 and 2, controlled selective movement of the tandem pilot valve plunger 190 is effected by a force motor drive 224 which as shown may be of the linear drive type. The force motor drive 224 includes a force motor 226 which is responsive to command signals received from the aircraft cockpit whereby the force motor drive serves as a control input to the pilot valve plunger. The force motor preferably has redundant multiple parallel coils so that if one coil or its associated electronics should fail, its counterpart channels will maintain control. Also, suitable failure monitoring circuitry is preferably provided to detect when and which channel has failed, and to uncouple or render passive the failed channel.

As seen in FIG. 1, the force motor 226 includes a motor housing 228 which is secured to the auxiliary system housing 230 which in turn is secured to the system housing 40. Actuation of the motor effects linear movement of a threaded drive rod 232 in a direction parallel to the pilot valve plunger 190. The drive rod 232 has at its outermost end a socket 234 in which is closely fitted a ball 236 on one end of a crank 238. The crank 238 is medially pivoted at 240 in the auxiliary housing and has a ball 242 at its other end which is closely fitted in a socket 244 provided in an axial extension 246 of the plunger located in the chamber 82 and more particularly within the cylindrical skirt 84 of the piston end member 86. As shown, the cylindrical skirt and piston extension sleeve 80 are provided with slots which accommodate the crank extending therethrough. Accordingly, linear movement of the drive rod 232 will effect reverse corresponding axial movement of the plunger.

As best seen in FIG. 2, the overtravel stroke of the plunger 190 relative to the piston 74 is limited in one direction by engagement of a plunger collar 248 against the adjacent end of the porting sleeve 168 and in the other direction by engagement of the axial extension 246 against the adjacent interior face of the piston end member 86. By limiting the plunger stroke to a small amount of overtravel, the plunger and force motor will always closely track the piston position even if the piston stroke is relatively great. This keeps plunger length to a minimum, reduces response time at system turn-on, and reduces the amount of space otherwise required to accomplish the shut-off function as described hereafter.

The shut-off function is effected upon shifting of the shut-off valve sleeve 162 to its closed position seen in FIG. 3. Such shifting will occur whenever the fluid pressure acting upon the differential pressure surface areas 163, 165 of the valve sleeve at the ports 158 and 160 therein is insufficient to overcome the force exerted by the shut-off valve spring 174. This may occur upon failure of both independent hydraulic systems or upon shut-down of the electrical operational mode by the shut-down valves 136 and 138 after multiple failures have rendered such mode inoperative. Upon such failure or shut-down, the spring 174 will shift the shut-off valve sleeve 162 to its closed position whereat the inner end of the valve sleeve will be butted against the shoulder 250 of the piston end member 86.

When the shut-off valve sleeve 162 is in its closed position shown in FIG. 3, communication between the ports 182 and 214 and the cylinder pressure surfaces 114 and 122, respectively, is blocked by the shut-off valve sleeve. Accordingly, axial movement of the plunger 190 no longer will effect position control of the piston 74 as no longer will such movement effect selective application of fluid pressure to and from the cylinder pressure surfaces 114 and 122.

Instead, the shut-off valve sleeve 162 in such closed position effects release of fluid pressure from the cylinder pressure surfaces 114 and 122 to return passages 206 and 152, respectively. Release of fluid pressure from the cylinder pressure surface 114 is effected by port 254 in the piston 74 and port 256 in the valve sleeve which then is communicated by groove 258 with another port 260 in the valve sleeve that is connected to the passage 206 by another port 262 in the piston. Release of fluid pressure from the cylinder pressure surface 122 is accomplished through port 264 in the piston which then is communicated with the port 216 which is connected to the return passage 152 as indicated above.

As seen in FIG. 3, the ports 254 and 264 respectively are provided with centering rate control or metering orifices 266 and 268. Such orifices respectively control the rate at which fluid is ported from the cylinder pressure surfaces 114 and 122 as the main control servo valve sleeve 36 and thus the piston is moved to a centered or neutral position by a spring centering device 282 for system operation in the manual mode. The spring centering device 282 can be seen at the right in FIG. 1 and may be conventional.

Before discussing the operation of the control actuation system 70, it is noted that the actuation system housing 78 is of rip-stop construction. More particularly, the housing 78 includes separate sub-housings 78*a* and 78*b* which house the actuation system elements associated with the forward and aft hydraulic systems, respectively, as seen in FIG. 1. Accordingly, a crack in one sub-housing disabling operation of the system elements associated with one hydraulic system will not propagate into the other sub-housing whereby sysem elements in such other sub-housing will remain operative to effect control of the main control servo valve 30.

Operation

During normal operation of the control actuation system 70 in the electrical mode, each shut-down valve 136, 138 is energized. This supplies fluid pressure to the actuator mechanism 72 and more particularly supplies fluid pressure from the aft and forward hydraulic systems to the source pressure surfaces 118 and 124 of the piston sections 104 and 106, respectively. Fluid pressure also is supplied to the ports 158 and 160 whereupon the shut-off valve sleeve 162 is shifted from its closed or hard-over position of FIG. 3 to its open position of FIG. 2. With the shut-off valve sleeve in its open position, fluid pressure is applied freely to the valving sections of the tandem pilot valve plunger 190 and controlled positioning of the main control valve sleeve 36 may be effected by the actuator 72 in response to electrical command signals received from the aircraft cockpit.

It will be appreciated that simultaneous energization of the shut-down valves 136 and 138 will not cause large turn-on transients because the pressure surfaces of the piston sections 104 and 106 result in equal and opposite forces on the piston by reason of their pressure area and porting relationships. In addition, because of the sizing and arrangement of the piston pressure surfaces, any pressure variations in either return or supply of the hydraulic systems will not result in a significant force imbalance on the piston.

Moreover, in the event one of the hydraulic systems fails or is shut down, the piston section and pilot valve plunger valving section coupled to the still functioning hydraulic system will maintain controlled positioning of the main control servo valve sleeve 36 in response to command signals received by the force motor 226. Also, upon shut-down of one of the hydraulic systems, all of the pressure surfaces of the thusly rendered inoperative piston section will be exposed to return pressure. Since the effective areas of the opposed pressure surfaces of the piston sections are equal, any pressure variations in return pressure will not result in any significant force imbalance acting on the inoperative piston section.

Such position control also will be maintained even though one of the channels of the electrical mode fails or is rendered inoperative. However, if both channels fail or are rendered inoperative requiring reversion to the manual operational mode, both shut-down valves 136 and 138 are de-energized. This connects the source pressure surfaces 118 and 124 of the piston sections 104 and 106 to return pressure and effects shifting of the shut-off valve sleeve 162 to its closed position shown in FIG. 3. As the main control valve sleeve 36 is urged towards its centered or neutral position by the centering spring device 282, fluid will be pumped out of the actuator mechanism at a rate controlled by the then existing pressures due to the spring force and the centering rate control orifices 148, 150, 266, and 268. Depending on the direction of centering movement, either the centering rate control orifices 150 and 266 or the orifices 148 and 268 will act in concert to control the rate of centering. As control orifices are provided for each piston section, centering rate control is ensured even if fluid is totally lost from one of the hydraulic systems. Moreover, centering rate control is effective regardless of the position of the piston.

When in the manual operational mode, the main control servo valve sleeve 36 is held in its centered or neutral position by the centering spring device 282. In the unlikely event that a relatively large reaction force is applied on the valve sleeve which exceeds the holding capability of the centering spring device, fluid pressure behind the opposing pressure surfaces of the piston sections 104 and 106 would be built up. As a result, a relatively large resistive force would be caused to act upon the piston depending on the duration of the applied reaction force thereby to resist back-driving of the piston. Of course, an extended reaction force application time would eventually move the piston from center upon the pumping of fluid through the respective centering rate control orifices.

Pilot Valve Centering Device (FIG. 4)

Referring now to FIG. 4, wherein elements are identified by the same reference numerals used above to identify generally corresponding elements, the pilot valve plunger 190 may if desired be provided with a pilot valve centering device 284. Such device includes a spring 286 which bears in opposition against washers 288 and 290 and urges such washers respectively into engagement with radially inwardly extending, axially opposed shoulders 292 and 294 on an axially extending, tubular extension 296 of the piston 74. In addition, the spring urges the washers 288 and 290, respectively, into engagement with radially outwardly extending, axially opposed shoulders 298 and 300 on a plunger extension 302 which extends axially beyond the plunger socket 244 in which is snugly fitted the ball 246 of the crank 238. As shown, the extensions 296 and 302 are axially coextensive and the opposed shoulders thereon are equally axially spaced.

The purpose of such a pilot valve centering device is to hold the plunger 190 and piston 74 in a centered positional relationship which corresponds to the above mentioned null positional relationship, the spring 286 thereof preferably being installed in a pre-loaded condition such that a predetermined force will be required to produce movement of the plunger relative to the piston. As a result, undesirable step inputs that may result during turn-on or during certain failure transient conditions are reduced. During turn-on, the plunger will restrict flow to the cylinder pressure surfaces of the piston sections of the piston 74 by reason of the plunger and piston being held in their null positional relationship by the centering spring device. Accordingly, no transient turn-on movements of the piston will be effected assuming simultaneous energization of the shut-down valves 136 and 138. On the other hand, in the event of a last electronic channel failure where the remaining channel fails in a hard-over condition, such remaining channel will be able to produce an opposite cancelling force to within the mismatch range of the two channels. If the spring has a force capability greater than the channel mismatch potential, the centering spring device will urge the plunger to seek the null positional relationship with the piston thereby reducing the possible actuator transient step during shut-down of the electrical operational mode.

Rotary Force Motor Drive (FIGS. 5 and 6)

Referring now to FIGS. 5 and 6, wherein elements are identified by the same reference numerals used above to identify generally corresponding elements, there is shown a modified arrangement wherein controlled shifting of the pilot valve plunger 190 may be effected by a force motor drive 304 of the rotary type. The force motor drive 304 can be seen to include a force motor 306 having a motor housing 308 which is secured to the system housing 40. Coupled to the rotor of the force motor 306 is a crank 310 which extends perpendicularly to the axis of the pilot valve plunger 190 in slightly radially offset relationship. At the end of the crank 310 adjacent the plunger extension 246, the crank has a radially extending ball arm 312 which is snugly fitted in the cylindrical socket 244 of the plunger extension. Accordingly, rotation of the crank by the force motor will cause the ball arm to bear against the sides of the socket to effect axial movement of the plunger. The rise and fall of the ball during arcuate movement thereof will be accommodated by the socket, such ball sliding along the socket in a direction normal to the longitudinal axis of the plunger. Preferably, there is minimal frictional resistance to such rise and fall motion of the ball to avoid plunger side loads.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston.

2. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, said piston being movable to a null positional relationship with said pilot valve means providing balanced application of fluid pressure forces on said piston whereby said piston tracks said pilot valve means.

3. A system as set forth in claim 2, wherein said control input means includes a force motor responsive to command signals, and means drivingly connecting said force motor to said pilot valve means for effecting such controlled axial movement thereof.

4. A system as set forth in claim 3, wherein said means drivingly connecting includes a pivot arm connected at opposite ends to said pilot valve means and force motor, respectively.

5. A system as set forth in claim 3, wherein said means drivingly connecting includes a crank rotatably driven by said force motor, said crank including a radial arm connected to said pilot valve means for effecting axial movement of said pilot valve means upon rotation of said crank by said drive motor.

6. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, said opposed pressure surfaces of each piston section being opposed to corresponding pressure surfaces of the other piston section, and respective means for supplying fluid pressure from such respective sources thereof to said actuator and for disconnecting such supply to effect system shut-down.

7. A system as set forth in claim 6, further comprising centering means for urging said piston to a neutral position upon system shut-down, and means responsive to system shut-down for releasing fluid pressure acting on opposed corresponding pressure surfaces of said piston sections through respective metering orifices to control the rate at which said piston is moved to its neutral position by said centering means.

8. A system as set forth in claim 7, wherein said means responsive to system shut-down includes a shut-off valve member axially movable in said piston.

9. A system as set forth in claim 8, wherein said shut-off valve member and pilot valve means are concentrically arranged in said piston.

10. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, said opposed pressure surfaces of each piston section having unequal effective pressure areas, and means are provided for applying fluid pressure from such respective sources thereof normally only on the smaller area pressure surface of respective said piston sections, said valving sections of said pilot valve means being operable upon such axial movement of said pilot valve means relative to said piston either to apply fluid pressure from such respective sources thereof on the larger area pressure source of respective said piston sections or to release fluid pressure acting on said larger area pressure surfaces of respective said piston sections to respective returns therefor for fluid actuation of said piston in opposite directions.

11. A system as set forth in claim 10, wherein said smaller and larger area pressure surfaces of each piston section are axially opposed to and have effective pressure areas equal to corresponding pressure surfaces of the other piston section.

12. A system as set forth in claim 11, wherein said larger area pressure surface of each piston section has an effective pressure area approximately twice as large as that of said smaller area pressure surface thereof.

13. A system as set forth in claim 11, wherein each piston section has another pressure surface opposed to said larger area pressure surface thereof, and means are provided for releasing fluid pressure acting on said another pressure surface to the return corresponding to the respective piston section.

14. A system as set forth in claim 13, wherein said piston includes a piston sleeve and two piston heads axially arranged on said piston sleeve.

15. A system as set forth in claim 14, wherein one of said piston heads and piston sleeve have thereon said pressure surfaces of one piston section and the other piston head has thereon said pressure surfaces of the other piston section.

16. A system as set forth in claim 14, wherein one of said piston heads has radially inner and outer stepped faces forming said smaller area and another pressure surfaces of one piston section.

17. A system as set forth in claim 13, wherein said smaller area and another pressure surfaces of each piston section have a combined effective pressure area equal to said larger area pressure surface thereof.

18. A system as set forth in claim 17, wherein said smaller area and another pressure surfaces of each piston section have equal effective pressure areas.

19. A system as set forth in claim 17, further comprising respective shut-down means operable to release fluid pressure acting on said smaller and larger area pressure surfaces of respective said piston sections to the respective return therefor, whereby upon operation of either shut-down means, balanced pressure forces act on the respective piston section.

20. A system as set forth in claim 14, further comprising a shut-off valve member axially movable in said piston, and means responsive to the application of fluid pressure from either source thereof upon said smaller area pressure surfaces of said piston sections for moving said shut-off valve member from a closed position blocking such application and release of fluid pressure acting on said larger area pressure surfaces to an open position permitting such application and release of fluid pressure.

21. A system as set forth in claim 20, further comprising shut-down means operable to release fluid pressure acting on said smaller area pressure surfaces of respective said piston sections to respective returns therefor, centering means for resiliently urging said piston to a neutral position upon operation of said shut-down means, and means for urging said shut-off valve member to the closed position thereof upon such release of fluid pressure by said shut-down means.

22. A system as set forth in claim 21, wherein said shut-off valve member has porting means operative in the closed position of said shut-off valve member to release fluid pressure from said larger area pressure surfaces of said piston sections to respective returns therefor through respective centering rate control orifices to control the rate at which said piston is moved to the neutral position thereof by said centering means.

23. A system as set forth in claim 22, wherein said centering rate control orifices are located in said piston.

24. A system as set forth in claim 22, wherein said shut-off valve member and pilot valve member are concentrically arranged in said piston for relative axial movement.

25. A system as set forth in claim 24, wherein said shut-off valve member is in the form of a porting sleeve on said pilot valve means.

26. A system as set forth in claim 20, wherein said means for moving said shut-off valve member includes two differential pressure areas on said shut-off valve member, and means for communicating said differential pressure areas with fluid pressure applied to said smaller area pressure surfaces, respectively.

27. A system as set forth in claim 10, wherein said pilot valve means has exposed opposite end faces of equal effective pressure areas, and means are provided for applying the same fluid pressure on said end faces.

28. A system as set forth in claim 27, wherein said means for applying includes means for placing said end faces in fluid communication with one of such returns.

29. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, and pilot valve centering means for resiliently urging said pilot valve means to a null positional relationship with said piston providing balanced application of fluid pressure forces on said piston.

30. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, said piston being movable to a null positional relationship with said pilot valve means providing balanced application of fluid pressure forces on said piston, whereby said piston tracks said pilot valve means, and wherein means are provided to limit the overtravel stroke of said pilot valve means out of such null positional relationship with said piston.

31. A control actuation system useful in a dual hydraulic servo actuator control system for operating a control valve element therein, comprising an actuator, a tandem piston axially movable in said actuator and drivingly connectable to the control valve element, tandem pilot valve means axially movable in said piston, and control input means for axially moving said pilot valve means in opposite directions relative to said piston to effect position control of said piston, said piston including two serially connected piston sections each having axially opposed pressure surfaces, and said pilot valve means including two axially spaced valving sections respectively for controlling the differential application of fluid pressure from respective sources thereof on said opposed pressure surfaces of respective said piston sections to cause axial movement of said piston in opposite directions in response to such axial movement of said pilot valve means in opposite directions relative to said piston, whereby upon a loss of fluid pressure from one source thereof, fluid pressure from the other source may still be controllably applied to said piston by said pilot valve means to effect position control of said piston, said pilot valve means having exposed opposite end faces of equal effective pressure areas, and means for applying the same fluid pressure on said end faces.

32. A control actuation system useful in a dual hydraulic servo actuation control system for operating a control valve element therein, comprising an actuator, a tandem piston axially movable in said actuator and drivingly connectable to such valve element, said piston including two serially arranged piston sections each having a cylinder pressure surface and source and return pressure surfaces opposed to said cylinder pressure surface, said cylinder, source and return pressure surfaces of each piston section being opposed and having effective pressure areas equal to the corresponding cylinder, source and return pressure surfaces of the other piston section, means for communicating respective sources of high pressure fluid and returns therefor with said source and return pressure surfaces of said piston sections, respectively, and pilot valve means for selectively communicating said cylinder pressure surface of each piston section with the respective source and return for controlling axial movement of said piston.

33. A system as set forth in claim 32, wherein said cylinder pressure surface of each piston section has an effective pressure area approximately twice as large as that of said source pressure surface.

34. A system as set forth in claim 32, wherein said source and return pressure surfaces of each piston section have a combined effective pressure area equal to that of said cylinder pressure surface thereof.

35. A system as set forth in claim 34, further comprising means operable to release fluid pressure acting on said source and cylinder pressure surfaces of either piston section whereby balanced pressure forces act upon such piston section.

36. A system as set forth in claim 32, wherein said piston includes a piston sleeve and two piston heads axially arranged on said piston sleeve.

37. A system as set forth in claim 36, wherein one of said piston heads and sleeve has thereon said pressure surfaces of one piston section and the other of said piston heads and sleeve has thereon said pressure surfaces of the other piston section.

38. A system as set forth in claim 36, wherein one of said piston heads has radially inner and outer stepped faces forming said smaller area and another pressure surfaces of one piston section.

39. A system as set forth in claim 32, further comprising respective means for supplying fluid pressure from such respective sources thereof to said actuator and for disconnecting such supply to effect system shut-down.

40. A system as set forth in claim 39, further comprising centering means for urging said piston to a neutral position upon system shut-down, and means responsive to system shut-down for releasing fluid pressure acting on at least two opposed corresponding pressure surfaces of said piston sections through respective metering orifices to control the rate at which said piston is moved to its neutral position by said centering means.

41. A system as set forth in claim 40, wherein said pilot valve means includes a pilot valve plunger, and said means for releasing includes a valve sleeve concentric with said valve plunger and axially movable relative thereto.

42. A control actuation system useful in a hydraulic servo actuator control system for operating a control valve element therein, comprising an actuator, a piston axially movable in said actuator and drivingly connectable to the control valve element, a pilot valve member axially movable in said piston for directing fluid pressure against said piston to cause axial movement of said piston, said pilot valve member being operably connectable to control input means for effecting position control of said piston, centering means for urging said piston to a neutral position upon such control means being rendered inoperative, and means responsive to such control means being rendered inoperative for releasing fluid pressure acting on opposite sides of said piston through metering orifices to control the rate at which said piston is urged to the neutral position thereof by said centering means, said means for releasing including a shut-off valve member axially movable in said piston to a position providing for the release of fluid pressure from one side of said piston through a respective one of said metering orifices.

43. A system as set forth in claim 42, wherein said one side of said piston has a larger area pressure surface than the other side, and means are provided for normally applying such pressure fluid only on the smaller area pressure surface of said piston, said pilot valve member being selectively movable either to admit fluid pressure to said larger area pressure surface or to release fluid pressure acting on said larger area pressure surface for pressure actuation of said piston in opposite directions.

44. A system as set forth in claim 43, wherein said means for releasing further includes valve means responsive to such control means being rendered inoperative for precluding such normal application of fluid pressure on said smaller area pressure surface and for releasing fluid pressure on said smaller area pressure surface through a respective other of said metering orifices.

45. A system as set forth in claim 43, wherein said shut-off valve member when in said position precludes such admission and release of fluid pressure and when in another position permits such admission and release.

46. A system as set forth in claim 45, further comprising means for resiliently urging said shut-off valve member to said position, and means responsive to such normal application of fluid pressure on said smaller area pressure surface for moving said shut-off valve member to said another position thereof against said means for resiliently urging.

47. A system as set forth in claim 46, wherein said means for moving includes opposed pressure surfaces on said shut-off valve member of different effective pressure areas in fluid communication with said means for normally applying.

48. A control actuation system useful in a hydraulic servo actuator control system for operating a control valve element therein, comprising an actuator, a piston axially movable in said actuator and drivingly connectable to said valve element, said piston having a cylinder pressure surface and a source pressure surface and return pressure surface opposed to said cylinder pressure surface, said source and return pressure surfaces together having a combined effective pressure area equal to the effective pressure area of said cylinder pressure surface, means for communicating a source of high pressure fluid and return therefor with said source and return pressure surfaces, respectively, pilot valve means axially movable in said piston for selectively communicating said cylinder pressure surface with such source and return for controlling axial movement of said piston, means for supplying fluid pressure from such source thereof to said actuator and for disconnecting such supply to effect system shut-down, centering means for urging said piston to a neutral position upon system shut-down, and means responsive to system shut-down for releasing fluid pressure acting on opposed pressure surfaces of said piston through respective metering orifices to control the rate at which said piston is moved to its neutral position by said centering means.

49. A system as set forth in claim 48, wherein said means responsive to system shut-down includes a shut-off valve member axially movable in said piston.

50. A system as set forth in claim 49, wherein said shut-off valve member and pilot valve means are concentrically arranged in said piston.

51. A system as set forth in claim 1, wherein said opposed pressure surfaces of each piston section are opposed to corresponding pressure surfaces of the other piston section, said opposed pressure surfaces of each piston section have unequal effective pressure areas, and the opposed corresponding pressure surfaces of said piston sections respectively having equal effective pressure areas.

52. A system as set forth in claim 51, further comprising respective means for supplying fluid pressure from such respective sources thereof to said actuator and for disconnecting such supply to effect system shut-down.

* * * * *